US005351730A

United States Patent [19]

Lewellen et al.

[11] Patent Number: 5,351,730

[45] Date of Patent: Oct. 4, 1994

[54] MULTIPURPOSE PORTABLE WORKBENCH

[75] Inventors: Richard R. Lewellen; John A. Vura, both of Wooster; Stacy L. Wolff, Akron, all of Ohio

[73] Assignee: Rubbermaid Incorporated, Wooster, Ohio

[21] Appl. No.: 95,406

[22] Filed: Jul. 23, 1993

[51] Int. Cl.[5] ..... B25H 1/00

[52] U.S. Cl. ..... 144/286 R; 108/59; 182/181; 144/286 A; 269/296; 269/900

[58] Field of Search ..... 108/55.1, 55.3, 59; 182/181; 144/286 R, 286 A; 248/346; 269/296, 900, 901

[56] References Cited

U.S. PATENT DOCUMENTS

| | | | |
|---|---|---|---|
| D. 230,801 | 3/1974 | Hickman | D6/179 |
| D. 243,820 | 3/1977 | Hickman | D8/74 |
| D. 250,079 | 10/1978 | Hickman et al. | D6/178 |
| D. 251,167 | 2/1979 | Isles | D6/177 |
| 2,541,508 | 2/1951 | Fleming | 144/286 R |
| 2,637,358 | 5/1953 | Larson | 144/286 R |
| 3,615,087 | 10/1971 | Hickman | 269/244 |
| 3,841,619 | 10/1974 | Hickman | 269/244 |
| 4,034,684 | 7/1977 | Carson et al. | 108/127 |
| 4,076,229 | 2/1978 | Hickman | 269/139 |
| 4,127,260 | 11/1978 | Hickman | 269/139 |
| 4,140,309 | 2/1979 | Hickman | 269/139 |
| 4,154,435 | 5/1979 | Alessio | 269/139 |
| 4,155,386 | 5/1979 | Alessio | 144/286 |
| 4,157,174 | 6/1979 | Hickman et al. | 269/139 |
| 4,159,821 | 7/1979 | Hickman | 269/139 |
| 4,169,606 | 10/1979 | Hickman | 269/139 |
| 4,223,881 | 9/1980 | Hickman | 269/139 |
| 4,231,557 | 11/1980 | Blachly et al. | 269/139 |
| 4,239,195 | 12/1980 | Oltman et al. | 269/16 |
| 4,252,304 | 2/1981 | Pettican | 269/139 |
| 4,256,294 | 3/1981 | Hickman | 269/16 |
| 4,265,435 | 5/1981 | Stiltz et al. | 269/139 |
| 4,278,243 | 7/1981 | Alessio | 269/16 |
| 4,291,869 | 9/1981 | Hickman | 269/139 |
| 4,310,150 | 1/1982 | Andrews | 269/139 |
| 4,360,047 | 11/1982 | Maret | 144/286 R |
| 4,364,548 | 12/1982 | Eccardt | 269/139 |
| 4,412,676 | 11/1983 | Jackson | 269/101 |
| 4,415,149 | 11/1983 | Rees | 269/88 |
| 4,442,779 | 4/1984 | Basten | 108/131 |
| 4,483,524 | 11/1984 | Basten et al. | 269/139 |
| 4,527,786 | 7/1985 | Hsu | 269/154 |
| 4,757,849 | 7/1988 | Morris | 144/287 |
| 4,880,221 | 11/1989 | Richards | 269/139 |
| 4,896,612 | 1/1990 | Salloum | 269/900 |
| 4,909,491 | 3/1990 | Cheng | 269/16 |

OTHER PUBLICATIONS

Catalog Page, Workbenches; Waterloo Industries, 300 Ansborough Ave., Waterloo Iowa 50704. Publication Date 1990.

Page 32, Sawhorses; Sparty's Address Unknown. Publication Date 1992.

Page 36, Stow Horses; Alto's Handy Helpers, Address Unknown. Publication Date 1992.

Advertisement, Sawhorse; Davalco Products, 301 West 53rd St., Suite 3D, New York City, N.Y. 10019. Publication Date May 1992.

Advertisement, Saw Horses; Handsome Rewards, 19465 Brennan Ave., Perris, Calif. 92379. Publication Date 1990.

Advertisement, Saw Workcenter; Harbor Freight, Address Unknown. Publication Date 1992.

*Primary Examiner*—W. Donald Bray

*Attorney, Agent, or Firm*—Richard B. O'Planick; Lisa B. Riedesel

[57] ABSTRACT

A carpenter's workbench is disclosed comprising a freestanding frame body (4) supported by four legs (6). A longitudinal channel (46) of T-shape profile and a V-shape groove (48) extend into a top surface (14) of the body (4) and are adapted to receive and render stationary lengths of lumber and tubular pipe, respectively, such that ends which overhang the workbench may be severed. Alternatively, a length of two by four inch wood may be situated horizontally and secured within an upper portion (50) of the channel (46) to provide a wood work surface if desired. Peripherally located surfaces (28, 36, 64) are provided having means (30, 32, 38, 62) for securing work tools to the workbench. Storage compartments (40, 42) are further provided to store hardware.

17 Claims, 7 Drawing Sheets

MULTIPURPOSE PORTABLE WORKBENCH

BACKGROUND OF THE INVENTION

1. Field of the Invention

The invention relates generally to portable workbenches, and more specifically to such workbenches which axe multifunctional, serving as both a workbench and a portable sawhorse.

2. The Prior Art

Portable workbenches axe well known in consumer markets. U.S. Pat. Nos. 3,841,619; 4,034,684; and 4,159,821 axe representative of such workbenches.

Commercial portable workbenches generally comprise a freestanding frame supported by four legs which may or may not be collapsible. The frame has disposed at its top a bifurcated clamping surface which, by operation of a vice mechanism, can clamp work articles between the clamping surfaces. The clamping surfaces are typically wooden, whereby enabling the user to use the clamping surfaces as a pounding base for driving nails into a workpiece. The workbenches, in addition to serving as a portable bench, also can serve as sawhorses for assisting in the cutting of lumber or other articles to size.

While the above-described available workbenches work well and have been commercially well received, certain shortcomings prevent them from representing an optimum solution to the consumer's needs. First, the workbenches are necessarily relatively expensive, requiring expensive hardware for the clamping mechanism and for the leg brace mechanism which allow the legs to collapse for storage. This high cost reduces the product's appeal to consumers.

Secondly, the clamping surfaces of the workbenches are permanently attached to the frame, and with extensive use as a pounding surface, can deteriorate from imbedded nails. In addition, the workbenches lack a convenient means for transporting and storing tools and hardware which are typically used in carpenter jobs. Further, the workbenches are less than acceptable when used as sawhorses, because the clamping mechanisms are not suited for quick and easy advancement of a piece of lumber. Their flat clamping surface tops also do not provide the means to retain a piece of lumber for convenient cutting at either end.

Lastly, the available workbenches are heavy to lift because of their metal frame, reducing their mobility and utility to the consumer.

SUMMARY OF THE PRESENT INVENTION

The subject invention overcomes the deficiencies in known portable workbenches. A freestanding frame is provided, molded unitarily of light-weight plastics material. The frame is supported by four legs and will nest with second, third, etc. like units, whereby providing convenient storage without expensive collapsing leg hardware.

The frame comprises an upper body having a planar longitudinal top surface into which a profiled T-shape channel extends. The channel is adapted to receive a standard two by four inch piece of lumber in either a horizontal or vertical configuration so that ends of the workpiece may be cut from either end. Alternatively, a piece of two by four lumber, cut to length, may be assembled to the body, within the channel, in a horizontal condition, whereby providing a wood surface on which to work. The piece of two by four lumber is fixed as a surface yet can be easily replaced when necessary.

A V-shaped groove is situated adjacent the channel within the body top surface, and can receive and support tubular products, such as pipe, for cutting at either end. In addition storage apertures and receptacles are provided at peripheral locations about the workbench body, conveniently accessible yet out of the way from the top work surface. An enclosed storage compartment is in the top surface of the body for storing small items such as nails, screws, small tools, wrenches, screwdrivers, pencils, etc.

Accordingly, it is an objective of the invention to provide a workbench which is stackable with like-configured other workbenches.

A further objective is to provide a workbench having a top surface adapted to receive and immobilize a length of lumber in alternate orientations for cutting.

Still a further objective is to provide a workbench having means within a top surface for receiving and immobilizing a length of tubular workpiece for cutting.

Yet a further objective is to provide a workbench having integral too storage means.

Another objective is to provide a workbench having integral hardware storage compartment.

A further objective is to provide a workbench of unitary construction capable of conventional manufacture of plastics material.

Still a further objective is to provide a workbench having a removable wood top work surface.

Yet a further objective is to provide a workbench which is economically and readily assembled and manufactured.

These and other objectives, which will be apparent to those skilled in the art, are achieved by a preferred embodiment which is described in detail below and which is illustrated by the accompanying drawings.

BRIEF DESCRIPTIONS OF THE ACCOMPANYING DRAWINGS

DESCRIPTION OF THE PREFERRED EMBODIMENT

Figure 1:
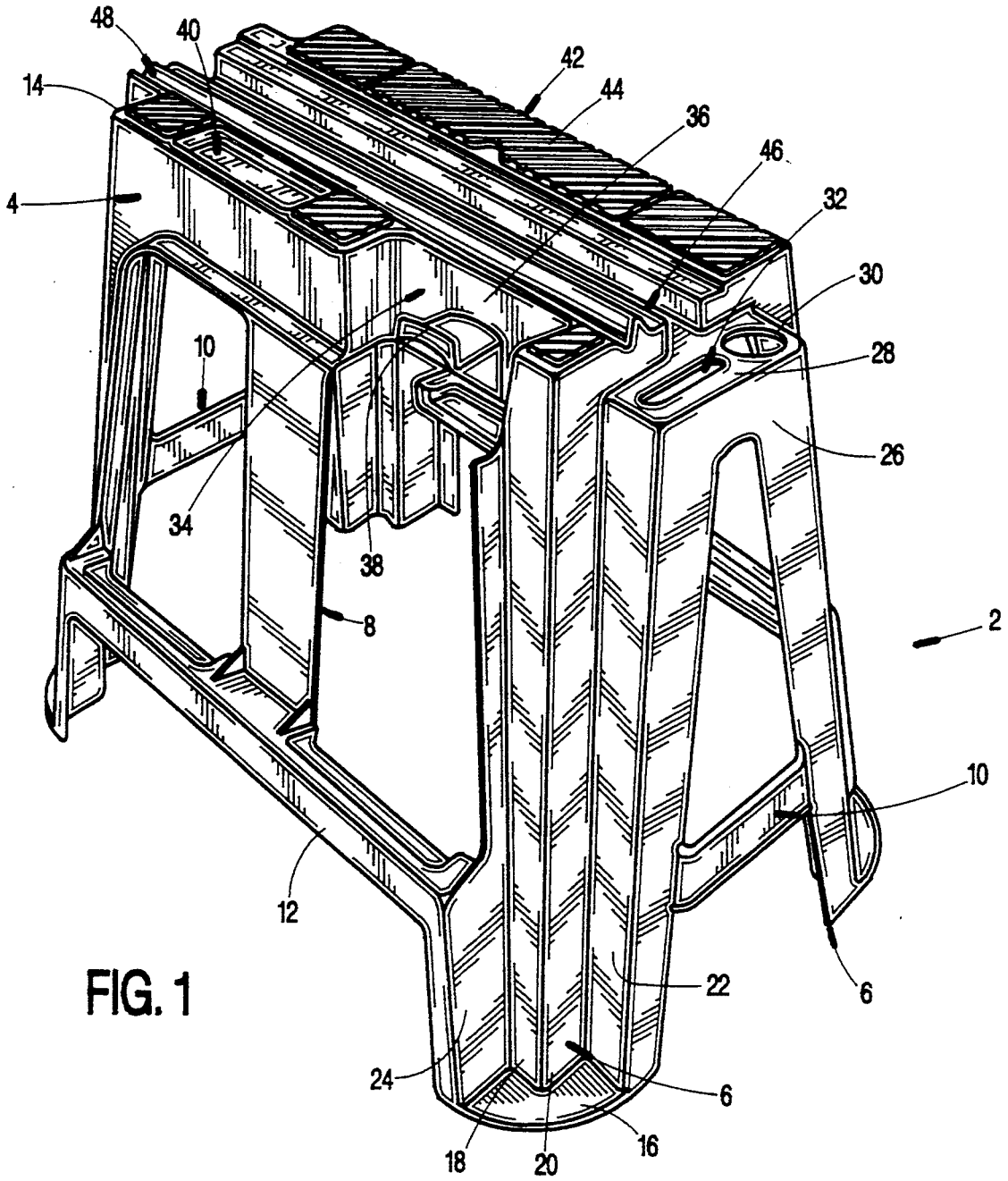
FIG. 1 is a right front perspective view of the subject workbench.
Figure 6:
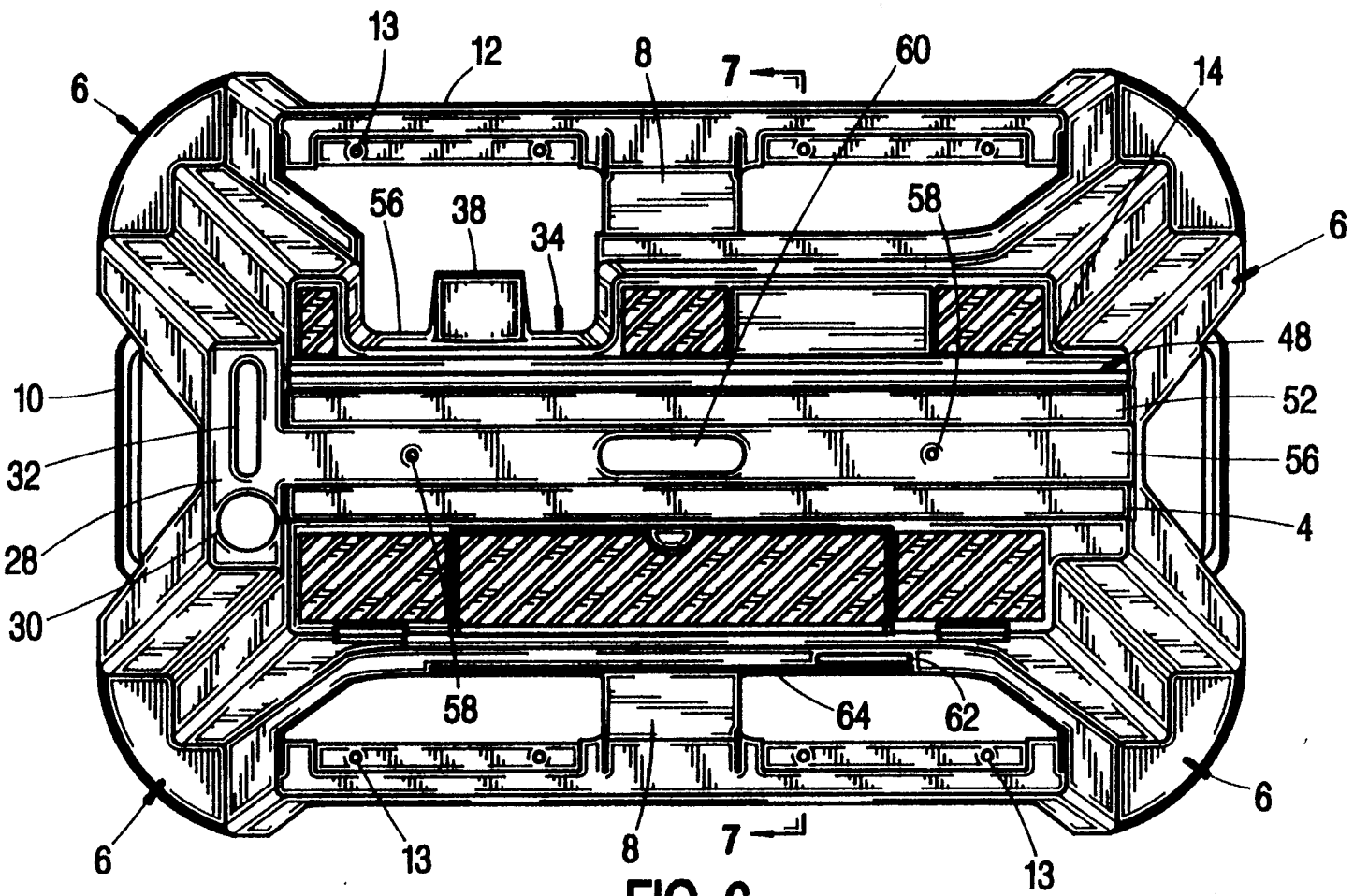
FIG. 6 is a top plan view thereof.
Figure 7:
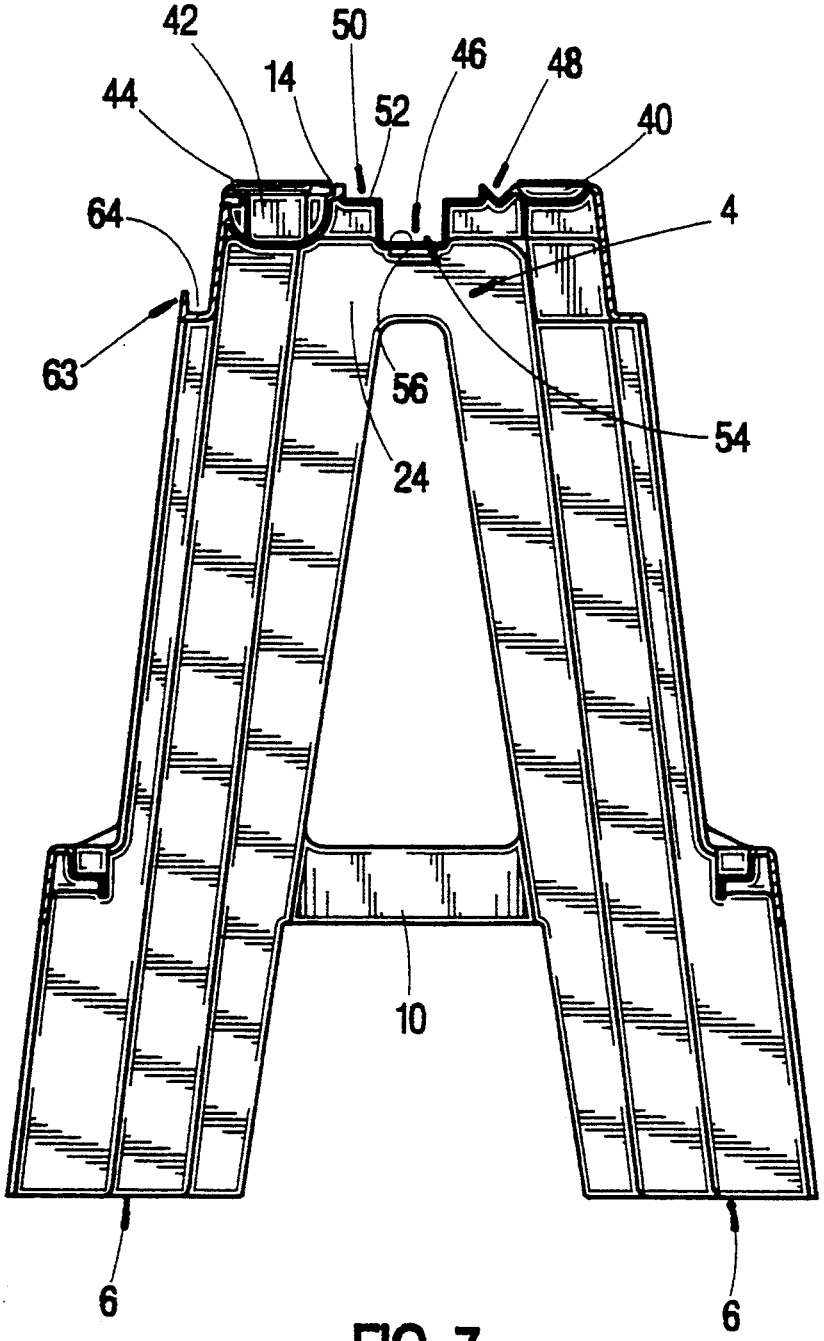
FIG. 7 is a transverse cross-section view thereof, taken along the line 7—7 of FIG. 6.

Referring to FIGS. 1, 6, and 7, the subject workbench 2 is shown to comprise a generally rectangular frame body 4 supported by four legs 6 which extend outward and downward from comers of body 4. Vertical reinforcement panels 8 midway along the longitudinal sides, horizontal bottom cross braces 10 at the ends, and horizontal bottom longitudinal braces 12 along the longitudinal sides of the workbench serve as structural reinforcement.

It will be appreciated that the frame body 4, legs 6, and braces 8–12 are unitarily formed of plastics material, such as polypropylene, by conventional molding process. The all plastic construction makes the workbench light weight for ease in relocation.

Continuing, the longitudinal braces 12 have four spaced throughholes 13 extending therethrough, whereby wooden cross panels (not shown) may be assembled by bolts or the like to the braces 12, if so desired. The result is the creation of a lower shelf for additional storage.

The body 4 terminates at a substantially planar top surface 14 and is open therebeneath such that the workbenches may be stacked one upon another. The configuration of the legs 6 facilitate such a stacking configuration, being defined by a lower pie shaped pad 16 from which W-shaped leg surfaces 18, 20, 22, and 24 extend. The innermost surfaces 18, 20 of each leg extend upwardly to the corners of body 4, as the outermost surfaces 22, 26 extend upward to body end portions 26. Body end portions 26 terminate at top surfaces 28 which are spaced downward from the plane of the body top surface 14.

The legs 6, so configured, nest within the legs of an underlying workbench when stacked thereupon, making the storage of the workbenches more space efficient, as well as making the display of the workbenches more space efficient for the retail store.

Disposed within the end portion top surface 28 is a circular aperture 30, suitable for receiving a tool handle, such as a hammer, and an ovular aperture 32 suitable for receiving and storing other tools such as screwdrivers. The lower level of surface 28 from surface 14 enables tools to be stored on surface 28 without interfering with work conducted on surface 14.

Figure 2:
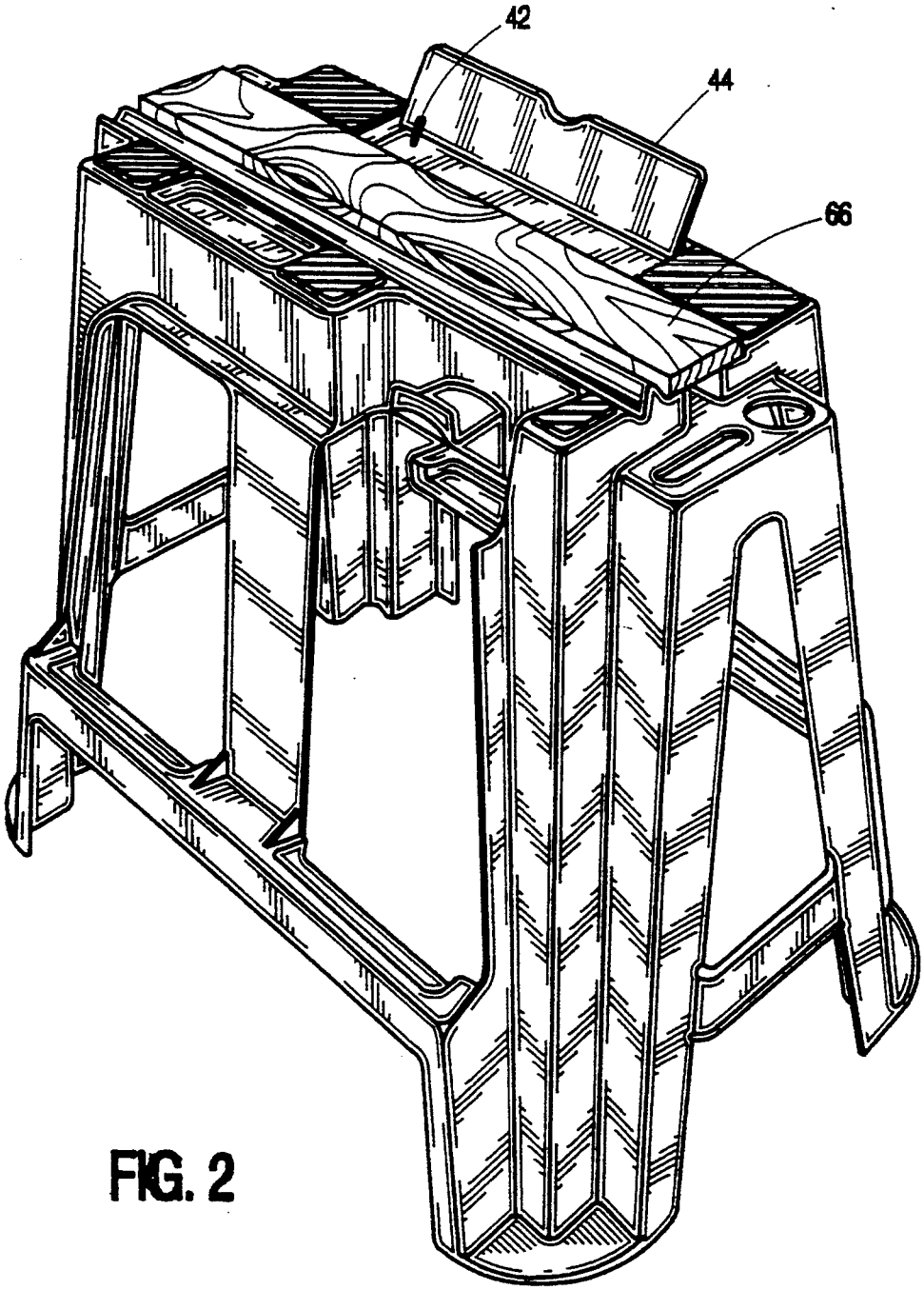
FIG. 2 is a right front perspective view of the subject workbench shown with a horizontal two by four piece of board in place, and the rearward storage compartment open.

As shown in FIGS. 1 and 6, a recess 34 extends into one longitudinal side of frame body 4, terminating at an interior wall 36. An upwardly open hook 38 extends into the recess 34 from wall 36 and, so positioned, can suspend coiled items such as extension cords or light cords. For additional storage, an open receptacle 40 and a lid covered receptacle 42 extend into surface 14. Receptacle 42, as shown in FIGS. 1, 2, and 6, is covered by a hinged lid 44, and may be used to store hardware items such as nails, bolts, small tools, wrenches, screwdrivers, pencils, etc.

Also extending into surface 14 and lengthwise across body 4 is a T-shaped channel 46 and a V-shaped groove 48. The channel is open ended and intended for use in receiving and rendering immobile a length of lumber so that ends thereof which overhang the ends of the body 4 may be cut. Similarly, groove 48 is open ended and intended for use in receiving and rendering immobile a length of pipe or tubing so that ends thereof may be cut.

The channel 46 is of T-shape, comprising an upper channel portion 54 of relatively wide width, preferably four inches, which terminates at an internal ledge 52. A lower channel portion 54, of narrower width, preferably two inches, extends downward from upper channel portion 54 to a floor 56. A pair of spaced apart apertures 58 extend through the floor 58 for a purpose explained below, and a central oval shaped slot 60 extends through the floor 58 as well, serving as a hand grip for transporting the workbench from place to place.

A slot 62 extends into a horizontal external ledge 63 of the body 4, and a channel 64 is located adjacent the slot 62, and extends along a longitudinal side of the body 4. The slot 62 may receive a dependent arm of a carpenter's square with the horizontal arm seated within the channel 64.

Referring now to FIGS. 1, 2, 3, and 6, a two by four inch wood stud 66 is shown cut to a length equivalent to the length of body 4. In FIG. 2, the stud 66 is shown in the horizontal position, seated within the upper channel portion 50 upon the ledge 52 therein. The stud may be secured therein by insertion of bolts therethrough (not shown) and through the bottom apertures 58 of the channel 46. The wood stud would then be positioned to provide a work surface for nailing into boards or the like. The clearance beneath the stud 66 represented by channel lower portion 54 enables the pounding of nails through the stud 66 but not into any part of the frame. Also, the wood stud 66 may be easily removed and replaced whenever needed.

Figure 3:
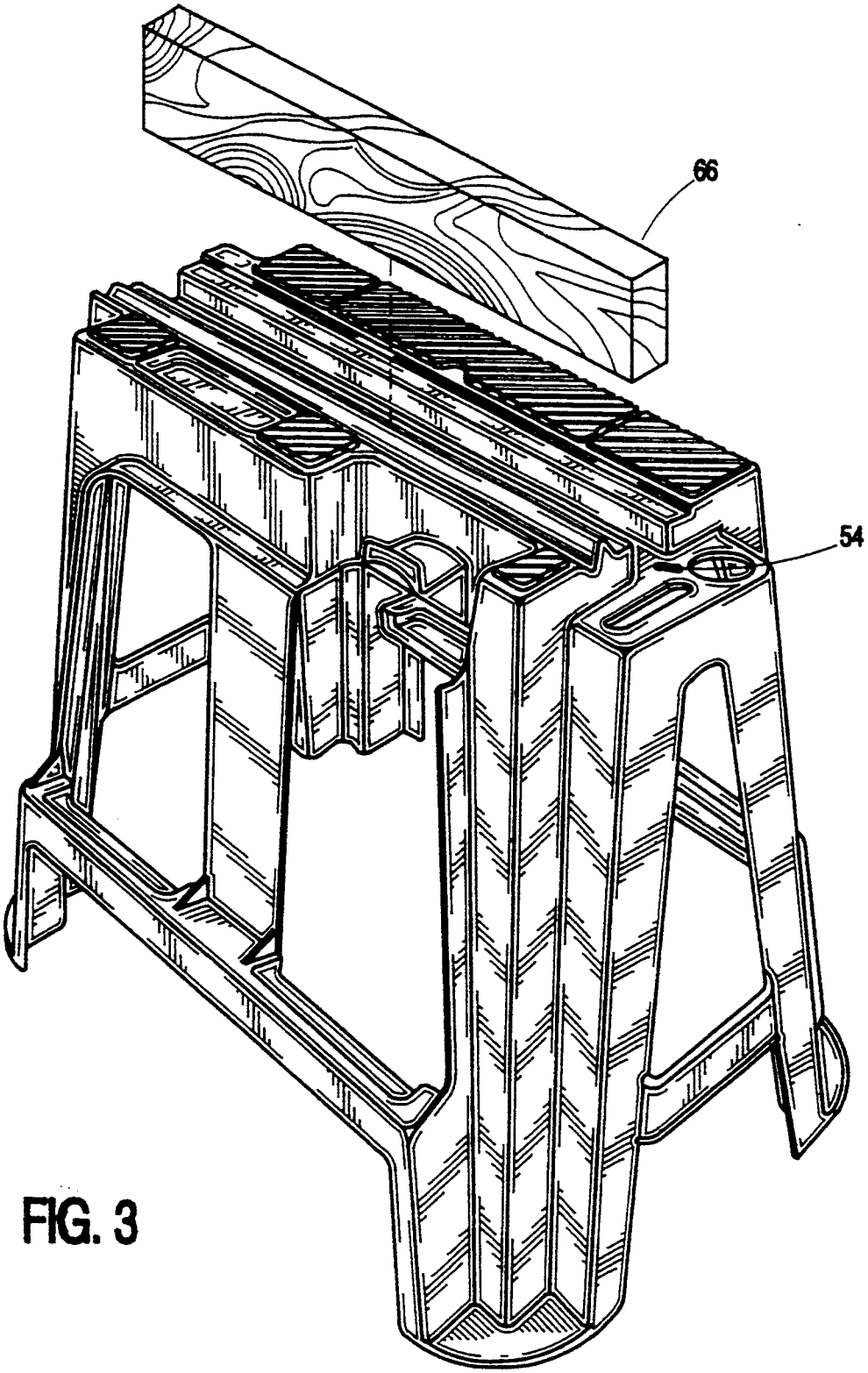
FIG. 3 is a right front perspective view of the subject workbench shown with a two by four piece of lumber oriented in an on-edge configuration relative to the top channel.

If the work bench is to used to cut the ends of a two by four inch workpiece, the workpiece may be horizontally seated into the channel upper portion 50 (shown by FIG. 2) with the workpiece ends overhanging the body 4. Alternatively, the workpiece may be oriented on-edge as shown in FIG. 3 and inserted into the lower channel portion 54 with its end(s) overhanging the body 4.

Figure 4:
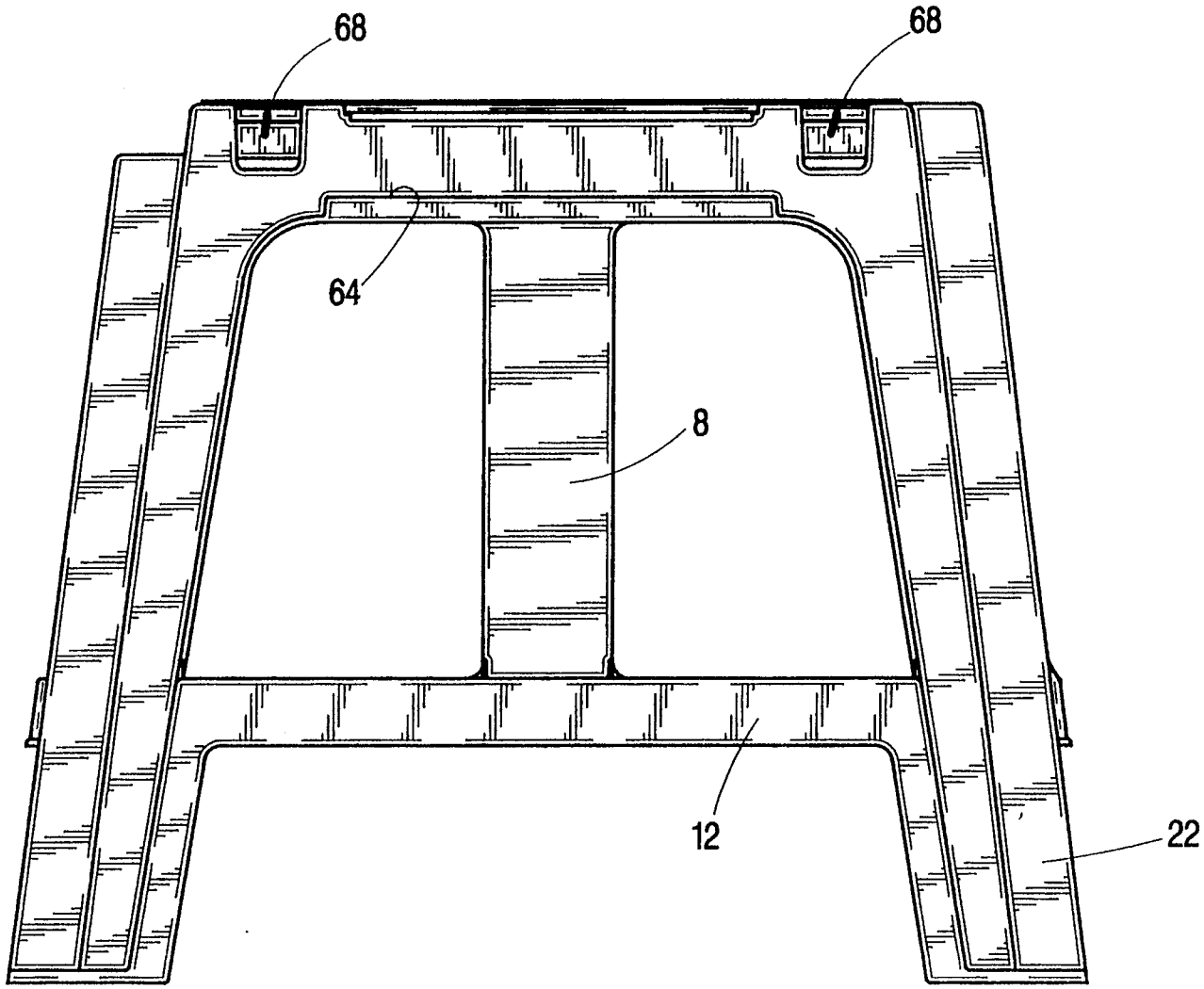
FIG. 4 is a rear elevation view thereof.
Figure 5:
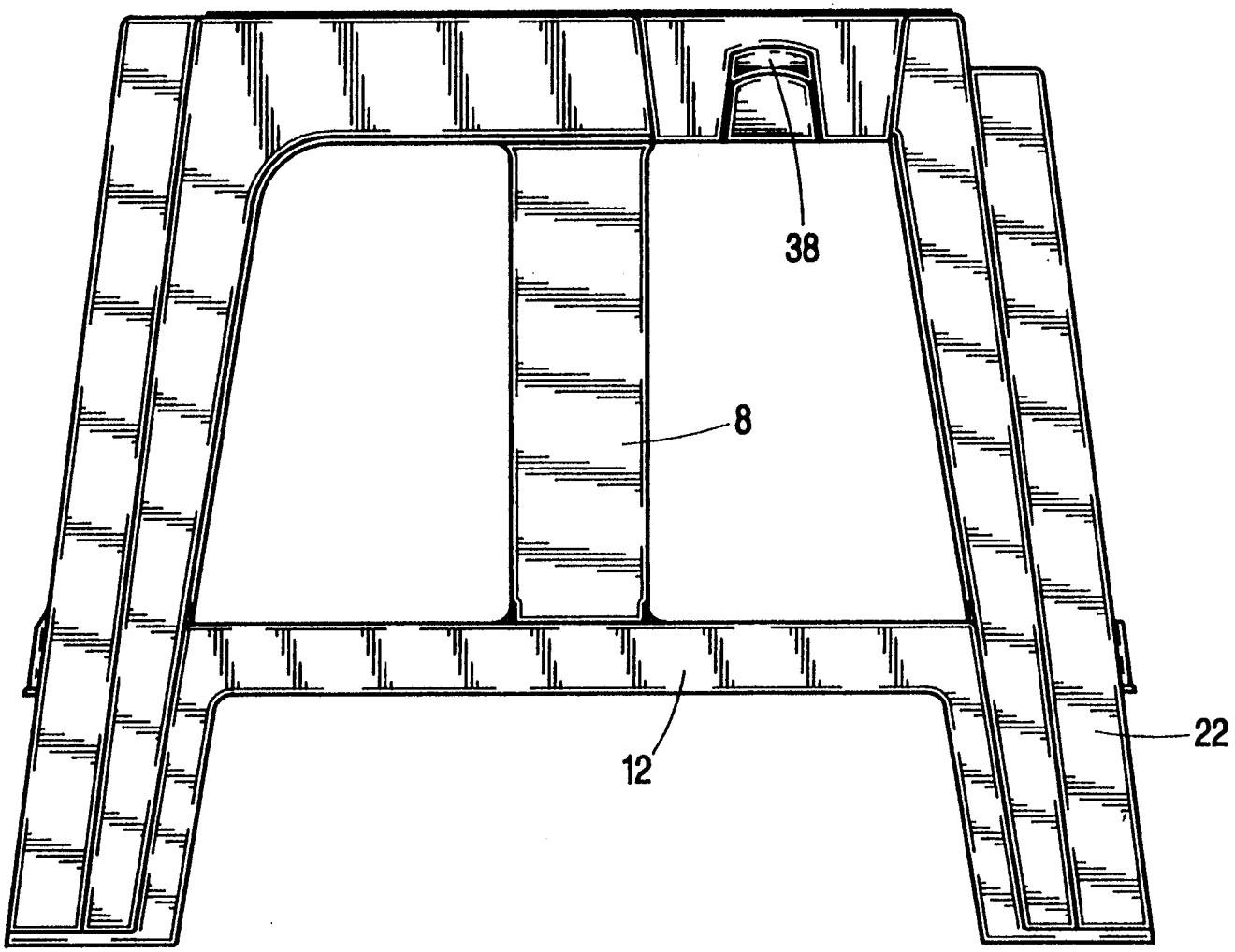
FIG. 5 is a front elevation view thereof.

A pair of through holes 68, shown best by FIG. 4, extend through longitudinal sides of the body 4, and may be used to accept C-clamps. Thus, a workpiece situated on surface 14 may be fixedly held thereagainst by the use of C-clamps extending into holes 68.

From the foregoing, it will be appreciated that the subject workbench is economical to produce, molded of conventional plastic by conventional means. Assembly is also easy, requiring only that the receptacle lid 42 be attached and the stud 66 secured within the channel it is desired to use the workbench in that manner.

In addition, the workbench accepts and stores hand tools such as a hammer, screw drivers, a square and cable which are conveniently stored in peripheral attachments below the plane of the work surface. So positioned, the tools are handy yet out of the way.

Also, it will be apparent that the workbench can accept and render immobile both lumber and pipe lengths by means of channel 46 and groove 48. The groove 48 has a top width dimension of approximately one inch while the channel 46, as described above, is dimensioned to receive a two by four inch stud in either a horizontal or on-edge orientation.

Lastly, the workbench is lightweight, easy to transport, and by virtue of its stacking configuration, space efficient to store.

While the above describes the preferred embodiment, the subject invention is not to be so restricted. Other embodiments, which will be apparent to one skilled in the art, and which utilize the teachings herein set forth, are intended to be within the scope and spirit of the subject invention.

We claim:

1. A carpenter's workbench comprising a freestanding frame supported by four legs, the frame comprising:

an elongate body having a planar longitudinal top surface;

a longitudinal profiled channel extending downward into the top body surface, the channel having an T-shape cross-sectional provide dimensioned to alternatively receive a wood stud in a flat or on-edge condition, whereby enabling ends of the stud to be cut, the channel having a relatively wide upper portion dimensioned in width and depth to receive the wood stud in said flat condition.

2. A workbench according to claim 3, wherein the channel having a relatively narrow lower portion dimensioned to closely receive the wood stud in said on-edge condition.

3. A workbench according to claim 4, wherein the workbench having means for securing a length of the wood stud within the channel upper portion in the flat condition.

4. A workbench according to claim 2, wherein the body farther comprises a longitudinal groove extending downward into the body top surface and disposed parallel and adjacent to the channel, the groove having a V-shaped cross-sectional shape adapted to receive a rod of circular sectional shape, whereby enabling ends of the rod to be cut.

5. A workbench according to claim 2, wherein the body further comprises peripheral secondary surfaces disposed beneath the body top surfaces and tool holding means in the secondary surfaces for holding carpenter's tools.

6. A workbench according to claim 2, wherein the workbench body being composed of plastics material.

7. A carpenter's workbench comprising a freestanding frame supported by four legs, the frame comprising:

an elongate body having a planar longitudinal top surface;

a longitudinal profiled channel extending downward into the top body surface, the channel having an T-shape cross-sectional provide dimensioned to alternatively receive a wood stud in a flat or on-edge condition, whereby enabling ends of the stud to be cut, the body further comprises a storage compartment extending downward into the body top surface and having a lid component coplanar with the body top surface.

8. A carpenter's workbench comprising a freestanding frame supported by four legs, the frame comprising:

an elongate body having a planar longitudinal top surface;

a longitudinal profiled channel extending downward into the top body surface, the channel having an T-shape cross-sectional provide dimensioned to alternatively receive a wood stud in a flat or on-edge condition, whereby enabling ends of the stud to be cut, the body having sidewalls and further comprising a recess extending into at least one of the sidewalls and between the body legs, and the recess being open at the bottom and having a hook at an interior wall from which carpenter's tools can be suspended.

9. A carpenter's workbench comprising:

a freestanding frame comprising an elongate body defined by sidewalls, endwalls and terminating at a top surface; and further comprising four leg members connected to the body and supporting the body in a freestanding condition;

a longitudinal profiled channel extending downward into the top body surface, the channel having a T-shape cross-sectional shape extending from the body top surface to an internal channel floor;

the channel having a relatively wide upper portion terminating at an internal step surface, and a relatively wide lower portion terminating at the internal channel floor; and a wood stud having four sides and extending longitudinally relative to the channel; and the channel upper portion having a width and depth dimensioned to receive the wood stud in a flat condition.

10. A workbench according to claim 9, wherein further comprising attachment means for securing the wood stud in the channel upper portion above the channel lower portion.

11. A workbench according to claim 10, wherein the channel lower portion having a width and depth dimensioned to closely receive a wood stud in an on-edge condition.

12. A workbench according to claim 9, wherein the body further comprises peripherally located secondary surfaces disposed below the body top surface and including tool holding means for holding carpenter's tools.

13. A workbench according to claim 12, wherein the tool holding means comprising apertures extending through the secondary surfaces.

14. A workbench according to claim 9, wherein the body further comprises a storage compartment extending downward into the body top surface and having a lid component coplanar with the body top surface.

15. A workbench according to claim 9, wherein the body further comprises a longitudinal groove extending downward into the body top surface and disposed parallel and adjacent to the channel, the groove having a V-shaped cross-sectional shape adapted to receive a rod of circular sectional shape, whereby holding the rod so that ends of the rod may be cut.

16. A workbench according to claim 9, wherein the body having a recess extending into at least one of the sidewalls and between the body legs, the recess being open at the bottom and having means at an interior recess wall from which carpenter's tools may be suspended.

17. A workbench according to claim 9, wherein the legs extending outward from corners of the body and having a W-shape in cross-section, with each leg of one said workbench nesting within a like-configured leg of an underlying second said workbench, whereby enabling the first and second workbenches to be stacked for storage.

* * * * *